US006027135A

United States Patent [19]

Hauglin

[11] Patent Number: 6,027,135

[45] Date of Patent: Feb. 22, 2000

[54] CROSS-COUNTRY OR TOURING SKI BINDING

[75] Inventor: Bernt-Otto Hauglin, Røeyken, Norway

[73] Assignee: Rottefella AS, Klokkarastua, Norway

[21] Appl. No.: 09/202,405

[22] PCT Filed: Jun. 13, 1997

[86] PCT No.: PCT/IB97/00699

§ 371 Date: Mar. 8, 1999

§ 102(e) Date: Mar. 8, 1999

[87] PCT Pub. No.: WO97/47367

PCT Pub. Date: Dec. 18, 1997

[30] Foreign Application Priority Data

Jun. 14, 1996 [DE] Germany ..... 196 23 825

[51] Int. Cl.[7] ..... A63C 9/00

[52] U.S. Cl. ..... 280/615; 280/634

[58] Field of Search ..... 280/614, 615, 280/633, 634, 626, 631, 619, 632

[56] References Cited

U.S. PATENT DOCUMENTS

| | | | |
|---|---|---|---|
| 4,927,168 | 5/1990 | Provence et al. | 280/615 |
| 4,995,632 | 2/1991 | Girault et al. | 280/615 |
| 5,048,855 | 9/1991 | Girault et al. | 280/615 |
| 5,092,620 | 3/1992 | Girault et al. | 280/615 |
| 5,152,546 | 10/1992 | Dunand et al. | 280/615 |
| 5,213,359 | 5/1993 | Girard | 280/615 |
| 5,224,730 | 7/1993 | Provence et al. . | |
| 5,228,714 | 7/1993 | Dekanovsky | 280/615 |

FOREIGN PATENT DOCUMENTS

| | | |
|---|---|---|
| 2635014 | 2/1990 | France . |
| 2645764 | 10/1990 | France . |
| 3128009 | 2/1983 | Germany . |
| 3924915 | 2/1990 | Germany . |
| 9200453 U | 4/1992 | Germany . |
| 9320530 U | 11/1994 | Germany . |

*Primary Examiner*—Richard M. Camby
*Attorney, Agent, or Firm*—Andrus, Sceales, Starke & Sawall

[57] ABSTRACT

A cross-country or touring ski binding for receiving a cross-country ski shoes which includes complementary engaging elements which are insertible into engaging elements of the binding. The engaging elements establish a hinge-like connection. The engaging elements at the side of the sole include a hinge axis which extends transversely to the longitudinal direction of the ski and approximately parallel to the sole running surface. The complementary engaging elements of the binding (10) include a holding element (13) which reaches over the shoe hinge axis and forms with the latter a hinge joint. The holding element (13) is movable from a locked position into a released position and vice versa by means of an operating lever (15) which is pivotably mounted on the binding. A flexor (16) operates between the front end of the sole and the ski and binding (10) and exerts a return force onto the shoe if it is lifted with the heel rising from the top of the ski. The locked and released position of the holding element (13) are defined by detent positions of the operating lever (15) and the binding.

12 Claims, 5 Drawing Sheets

CROSS-COUNTRY OR TOURING SKI BINDING

The invention relates to a cross-country or touring ski binding including a hinged liner including a holding element which reaches over complementary engaging elements of the sole.

A binding of this type is known from the DE-U-93 20 530. This binding distinguishes itself by robustness, good guidance properties as well as operationally safe operation; however, it is relatively elaborate in it design and thus of relatively heavy structure. However, these features play only a subordinate part for an adult binding. The emphasis of the conventional binding consequently lies in creating a particularly robust and operationally safe binding for extreme applications.

It is, therefore, an object of the present invention to offer a binding which is clearly simpler with regard to structural needs and which manages with a minimum of components and which is of respective lightweight design, so that it is suitable particularly for children.

SUMMARY OF THE INVENTION

This object is achieved according to the invention by the binding including the hinged holding element constructed with the locked position of the holding element defined by detent elements configured on the operating lever and the binding, in such a manner that detention is carried out on its own, i.e. independently from the load of a flexor or other spring-elastic locking elements, by positive co-operation of the detent elements structural details and further developments of the basic scope of the present invention are described in the subclaims. This applies in particular to a particular design, which is independently from the binding design, and wherein the holding element in the shut or closed position reaches over the hinge axis and includes a recess or cutout extends parallel to the hinge axis. As a result, during an upward parallel pivotal movement of the shoe heel against the load of the flexor no force component, or only an insignificant one, is applied in the opening direction of the holding element.

Thus, the basis of the present invention lies in that the locking and release position of the holding element are defined by respective detent positions of the handle or the operating lever to which the holding element is coupled. This way, locking springs and beyond dead-centre structures can be dispensed with. This allows a considerable reduction in structural needs. When making the operating lever of plastic, then a particularly lightweight structure is possible which offers itself in particular for children. The detent positions provided according to the invention clearly show a child that the binding is either in the release or locking position. When operating the operating lever, the child can feel which position the holding element is in. The entire binding includes only a few parts, i.e. a flexor, the operating lever including pivotal axis, the holding element and the binding housing or the base on which the aforementioned elements are mounted. This base is preferably composed of a sheet metal element, wherein the base includes two laterally upward bent jaws and in its mounted state at the rear an upward bent edge web which serves as a front stop for the hinge axis configured at the front sole of the shoe. A structural which is suitably shaped for fixing the operating lever, flexor and holding element, in particular in accordance with Claim 4. Fixing the flexor on the aforementioned base element is also carried out by the aforementioned parts, i.e. the operating lever or its pivotal axis on the one hand and the holding element on the other hand. Separate fixing means are then not required which particularly simplifies the overall design. The holding element in one embodiment is formed by a U-shaped bent wire lever. This form of embodiment also contributes to a reduction in overall weight.

Furthermore, the wire lever prevents, in contrast to plate-shaped locking elements, inclusion of snow or ice within the binding which ensures lasting operational efficiency. This form of embodiment is also claimed as an independent structural variant.

The embodiment wherein the recess or cutout is provided serves to safely hold the holding element in the locking position. It is prevented by these measures such that an upward pivotal movement of the shoe heel or a respective rotation of the shoe integrated hinge axis does not push the holding element which reaches over the latter forward into the shoe release position against the detent effect between operating lever and binding housing or the aforementioned base element. The structures quasi produces a "mousetrap" for the hinge axis which is integrated into the shoe when the holding element is in the locking position. The variant is also claimed both in combination with the aforedescribed binding and independently therefrom.

DESCRIPTION OF THE DRAWINGS

A preferred form of embodiment of a cross-country or touring ski binding, which is particularly suitable for children, will now be described in more detail based on the enclosed drawing. Shown are, in FIG. 1: a binding according to the invention, in a side view.

DESCRIPTION OF ILLUSTRATED EMBODIMENT

Figure 1:
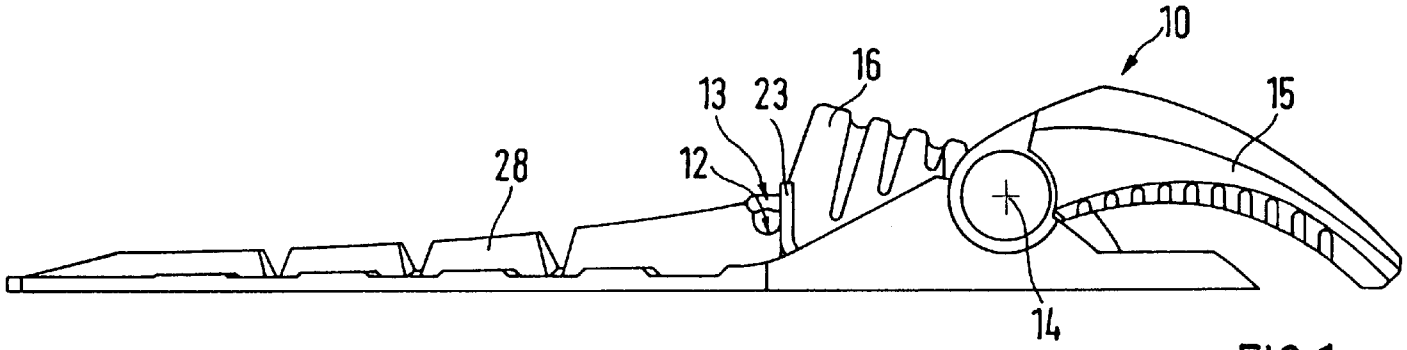
Figure 2:
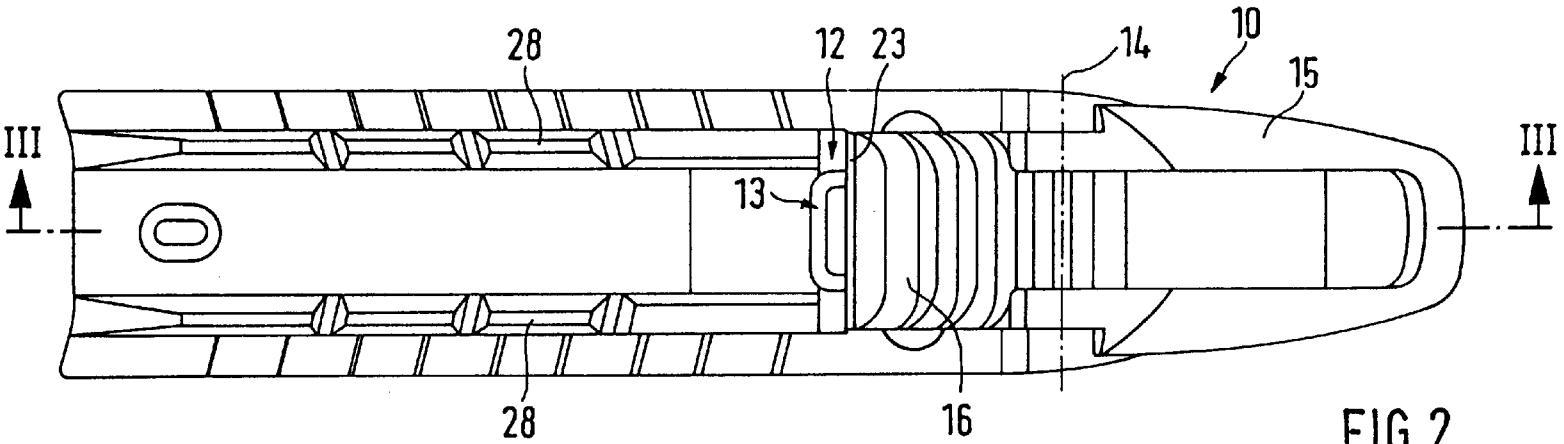
FIG. 2: the binding of FIG. 1, in a top view.
Figure 3:
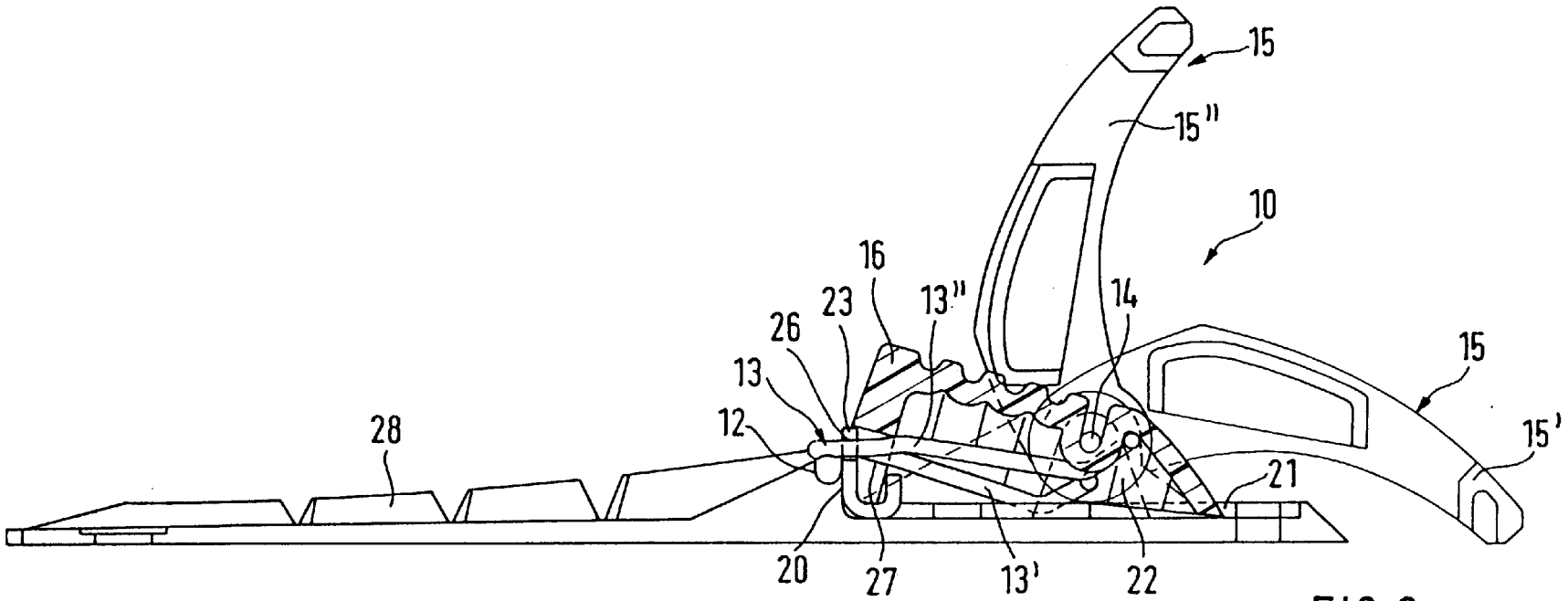
FIG. 3: the binding as in FIGS. 1 and 2, cross-sectionally along line III—III in FIG. 2.
Figure 4:
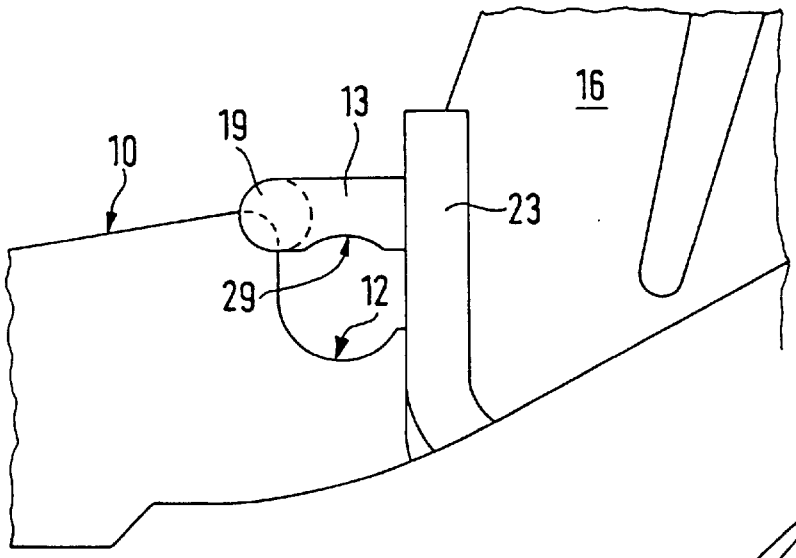
FIG. 4: the hinge mechanism of the inventive binding at the side of the binding, in a side view and at an enlarged scale.

FIGS. 1 to 3 illustrate a cross-county or touring ski binding 10 in its assembled state. This binding serves to fix a corresponding ski shoe comprising at its front sole, in particular at the end of its front sole, complementary engaging elements which are insertible into engaging elements of binding 10 for the purpose of producing a hingelike connection, and the engaging elements at the sole encompass a hinge axis which extends transversely to the longitudinal direction of the ski and approximately parallel to the tracking surface of the sole. The complementary engaging elements of binding 10 are formed by a groove 12, which 15 extends at the top of the binding transversely to the longitudinal direction of the ski and parallel to the ski footprint, so as to accommodate the hinge axis at the sole, as well as a holding element 13, which extends in the locked position of the binding over the groove and which is movable from a locked position as in FIGS. 1 and 2 into a released position (in FIG. 3 righthand position) and vice versa by means of an operating lever 15, which is pivotally mounted on binding 10 around an axis which extends transversely to the longitudinal direction of the ski and approximately parallel to the ski footprint. Between the front sole end of the shoe (not illustrated) and binding 10 operates a flexor 16 which exerts a return load on the shoe if the latter is lifted by its heel from the top of the ski. The locking and release position of holding element 13 is defined by respective detent positions of operating lever 15. This will be discussed in more detail later in conjunction with FIG. 5.

Figure 8:
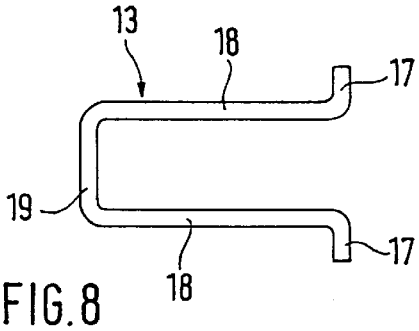
FIG. 8: the holding element used in the inventive binding for the hinge axis which is integrated into the shoe, in a top view.

Holding element 13 is in the illustrated form of embodiment formed by a U-shaped bent wire lever the respective free ends of both shanks are bent outward as in FIG. 8 whilst forming a mounting pins 17 which are insertible into respective receiving bores of the operating lever. Holding element 13 is then coupled to operating lever 15 via mounting pins 17. Both shanks of the U-shaped bent wire lever are denoted 18. The connecting web is denoted 19. The lever end of holding element 13 serve to establish a pivotal mount for the shoe or sole integrated hinge axis as can be seen clearly in FIGS. 1 and 3. The pivotal mount is accordingly restricted or defined on the one hand between the lever end of holding element 13 in the form of a wire lever and on the other hand transverse groove 12.

Figure 9:
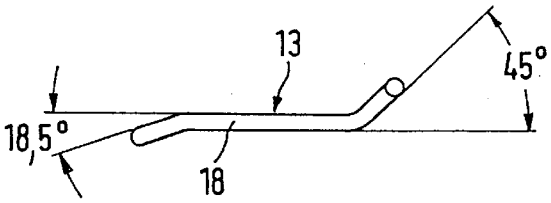
FIG. 9: the holding element as in FIG. 8, in a side view.
Figure 13:
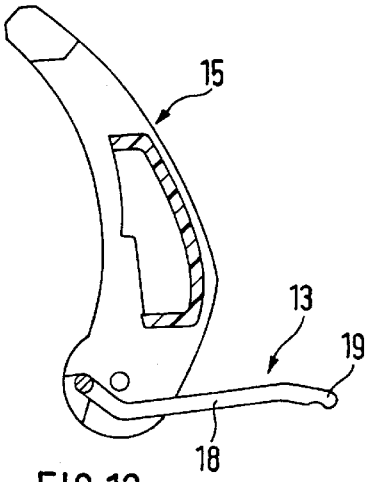
FIG. 13: the operating lever for the inventive binding in association with a modified holding element for the hinge axis which is integrated into the shoe in an open position and in a side view.
Figure 16:
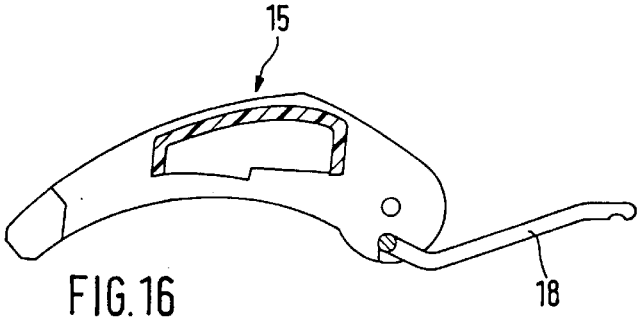
FIGS. 16–18: the operating lever with modified holding element in a closed state of the binding, respectively shown as in FIGS. 13–15.
Figure 14:
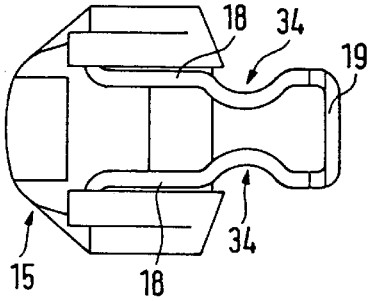
FIG. 14: the arrangement of FIG. 13, in a front view.

According to FIG. 9, the wire lever serving as holding element 13 has in a side view the shape of a longitudinally extended "Z", and according to FIG. 3 the positioning and to application of the wire lever on operating lever 15 is such that the end associated with the hinge axis of the shoe or the lever end of the wire lever extends during its to and fro movement approximately parallel to the ski footprint. For this reason, the angle of the lever end from the base surface of holding element 13 is less than the opposing angle of the free ends of both shanks 18. The first angulation is preferably approximately 18.5 degrees, whilst the second angulation is approximately 45 degrees as is illustrated in FIG. 9. FIG. 3 clearly shows that pivoting of operating lever 15 around pivotal axis 14 triggers a translatory to and fro movement of holding element 13. In FIG. 3, the locked position of holding element 13 is denoted 13' whilst the open position is denoted 13'. Accordingly, the locked position of the operating lever is denoted 15' and the open position of same is denoted 15'. In the open position, operating lever 15 is approximately vertically folded upwards as in FIG. 3.

Figure 6:
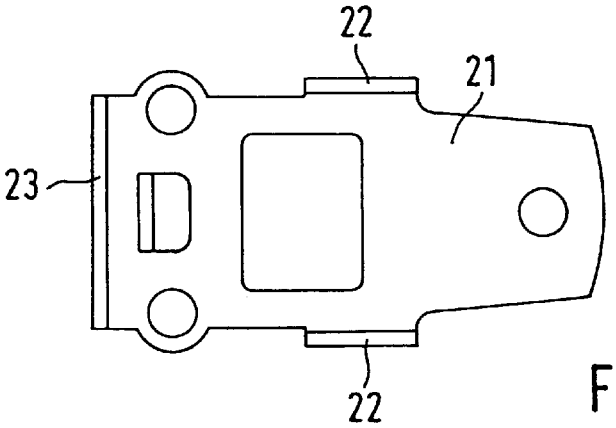
FIG. 6: a base plate of the binding for positioning additional binding elements, in a top view.
Figure 7:
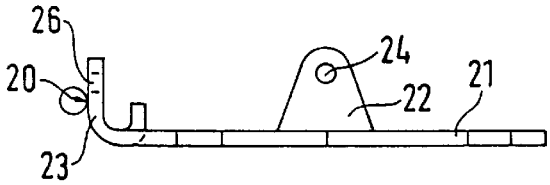
FIG. 7: the base plate as in FIG. 6, in a side view.

Holding element 13 extends through flexor 16 which has hollow walls and a front stop 20 at the side of the binding for the hinge axis configured at the front sole of the shoe. The binding comprises a base plate 21 which is mountable onto the ski footprint with two laterally upward bent jaws 22 and an edge web 23, at the rear when mounted, and which is also bent upwards, and which serves as front stop 20 for the hinge axis configured on the front sole of the shoe. The described base plate is separately illustrated in FIGS. 6 and 7, i.e. in a top view and in a longitudinal cross-section. Side jaws 22 and edge web 23 are then bent out of the plane of base plate 21. Accordingly, base plate 21 including jaws 22 and edge web 23 can be manufactured from a correspondingly cut stainless steel plate or the like.

The two laterally upward bent jaws 22 of base plate 21 comprise a respective bore 24 which serves to accommodate pivotal axis 14 of operating lever 15.

Figure 10:
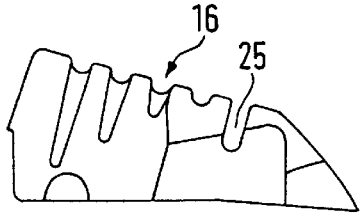
FIG. 10: the flexor used according to the invention, in a side view.
Figure 11:
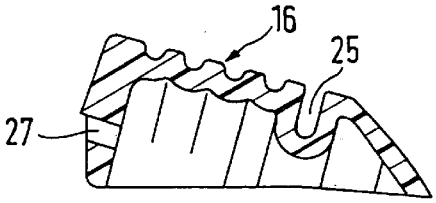
FIG. 11: the flexor as in FIG. 10, in a longitudinal cross-section.

Flexor 16 can be positioned on base plate 21 between the two lateral jaws 22 and rear edge web 23, and pivotal axis 14 of the operating lever 15 extends above flexor 16 transversely thereabove, i.e. within a transverse groove 25 configured in flexor 16, as is particularly clearly shown in FIGS. 10 and 11. The flexor is in a conventional manner of hollow design and is made of an elastic plastic or rubber material. Flexor 16 is held on base plate 21 by way of pivotal axis 14 of operating lever 15. Holding element 13 additionally serves to hold flexor 16 on base plate 21. For this purpose, the end of holding element 13 at the side of the web extends through an elongated hole, which extends parallel to the base plate, both into the rear upward bent edge web 23 of base plate 21 and into the associated rear end wall of flexor 16. The aforementioned elongated hole in edge web 23 is denoted 26. The corresponding elongated hole in the rear end wall of flexor 16 is denoted 27 (also see FIG. 7 or 11).

Figure 12:
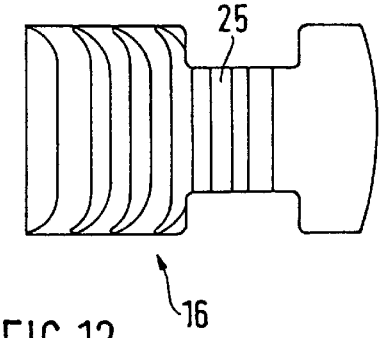
FIG. 12: the flexor as in FIG. 10, in a top view.

According to FIG. 12, the flexor has the shape of an "I" as seen from the top, and the one transverse web is broader than the other. The above description and FIG. 3 clearly show that flexor 16 is held exclusively by holding element 13 and pivotal axis 14 of operating lever 15. Accordingly, these two aforementioned assembly components serve a respective double function.

Adjacent behind transverse groove 12, as seen in the direction from the ski tip, lies a component as part of the shoe pivotal mount comprising two guide webs 28, which extend at a distance from each other and respectively in the longitudinal direction of the ski and which correspond with respective guide grooves at the bottom of the running sole of the ski shoe (not illustrated). The guide grooves are designed as so-called "crocodile" grooves. A detailed description can be dispensed with at this point as said guide grooves are a conventional assembly component.

Furthermore, it is of special interest that the end of holding element 13 which serves to establish the pivotal mount for the shoe or sole integrated hinge axis, i.e. its end at the side of the web has at the point which in the locked position reaches over the hinge axis a recess or cutout 29 which extends parallel to the hinge axis, so that when pivoting the shoe heel upwards against the load of flexor 16 no load component, or only an insignificant one, is applied in the opening direction of holding element 13 or in a forward direction thereonto. Due to cutout 29, which also corresponds relative to the shape with the shoe or sole integrated hinge axis, the hinge axis is safely held in transverse groove 12 without any danger of unintentional opening of the binding.

Figure 5:
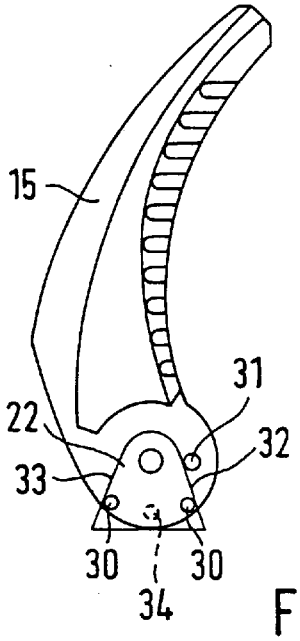
FIG. 5: the operating lever for the inventive binding with illustration of the associated detent mechanism, in a side view.

According to FIG. 5, the detent positions of holding element 13 are defined, on the one hand, by detent protrusions or detent buttons 30 or 31 arranged laterally at operating lever 15, i.e. integrated therewith, and, on the other hand, by detent cutouts arranged at lateral jaws 22 of base plate 21 or the front and/or rear definition 32 or 33 of the lateral jaws 22. The detent cutout associated with detent knob 31 in the associated side jaw 22 is denoted 34 in FIG.

5. In FIG. 5, the co-acting of detent knob 31 with detent cutout 34 serves to fix operating lever 15 in the locked position. Co-acting of detent knobs 30 with front and rear definition 32, 33 of lateral jaw 22 serves to fix the open position which is illustrated in FIG. 5. Operating lever 15 is preferably made of plastic so that integration of detent knobs 30, 31 is not too elaborate. The structural effort can be additionally reduced with co-action of these detent knobs with the front and rear definitions of the lateral jaws 22.

Figure 17:
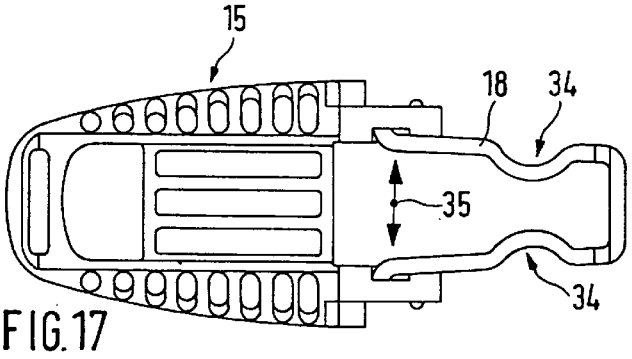
Figure 18:
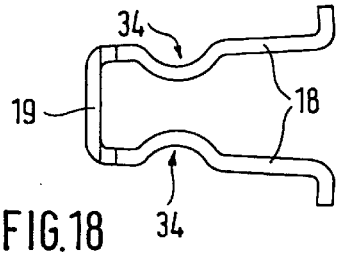
Figure 15:
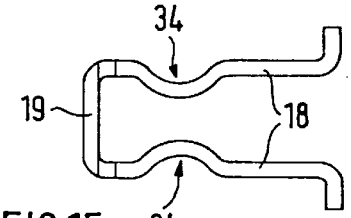
FIG. 15: the modified holding element, in a top view with opened binding.

In FIGS. 13 to 18, operating lever 15 is illustrated in association with a modified holding element 13 as well as in the open position of the binding (FIGS. 13–15) and in the skiing position of the binding (FIGS. 16–18), and both shanks 18 of the approximately U-shaped bent wire lever, which serves as holding element 13, are in their unloaded state slightly spread in the form of a V-shape as is illustrated in FIG. 18. The elastic pretensioning of both shanks 18 is indicated in FIG. 17 by means of a double arrow 35. At least one of both shanks 18, here both shanks 18, have in the area near binding web 19 between both shanks 18 a respective inwardly extending dent in the shape of an inward bend 34 which in the closed state of the binding according to FIGS. 16–18 detents and co-acts with the associated lateral definition of elongated hole 26 which is formed in base plate 21 and through which wire lever 18 extends. This secures, in particular additionally secures, the binding in a closed position. When opening the binding, i.e. when tipping upwards operating lever 15 into the position of FIG. 13, then both shanks 18 are moved towards each other by associated slanting surfaces on the inside of operating lever 15 against radial pretensioning 35 as in FIG. 17 inwards, i.e. towards each other into a position as in FIGS. 14 or 15. This cancels out the detent connection between bends 34 and the lateral definition of elongated hole 26 in base plate 21, so that the wire lever serving as holding element 13 can be displaced without larger resistance into a shoe release position.

All features in the description, the claims and the drawing are claimed as within the scope of the invention inasmuch as they are individually or in a combination new relative to the prior art.

List of reference marks

10 Binding
12 Groove
13 Holding Element
14 Pivotal Axis
15 Operating Lever
16 Flexor
17 Mounting Pin
18 Shank
19 Connecting Web
20 Stop
21 Base Plate
22 Jaw
23 Edge Web
24 Bore
25 Transverse Groove
26 Elongated Hole
27 Elongated Hole
28 Guide Web
29 Cutout
30 Detent Knob
31 Detent Knob
32 Front Definition of Lateral Jaw
33 Rear Definition of Lateral Jaw
34 Inward Bend
35 Double Arrow

I claim:

1. A cross country and touring ski binding for cross-country ski shoes having a front sole with the outer front end having complimentary engaging elements, insertable engaging element configured for establishing a hinged connection with said engaging elements, said engaging elements include a holding element (13) configured to extend over the complimentary engaging elements of the sole, said holding element being movable between a locked position and a release position including a rotatably and pivotably mounted operating lever (15) in combination with a flexor (16) mounted to the binding at the forward end of the front sole and configured to subject the shoe at said outer front end to a return force in response to lifting of the ski boot with the heal raising from the top side of the ski, the improvement wherein said operating lever (15) and said binding have respective complimentary detent element (30, 31;34) in the operating lever (15) and on the binding (10) said complimentary detent elements configure to establish positive cooperation of the detent elements (30, 31; 34) and with the detention thereby executed independently from other loads including the load of the flexor (16).

2. The ski binding of claim 1, wherein said holding element (13) has a front end directly hinged to the operating lever (15) and configured with the pivoting of the operating lever 15 establishing a translatory to and fro movement of the holding element, a front stop (20, 23) at the side of the binding with the hinge axis configured at the front sole of the ski shoe, said holding element one through the flexor (16) and said front stop (20, 23).

3. The ski binding of claim 1, wherein said operating lever 15 engages and holds said flexor (16) in said ski binding (10).

4. The ski binding of claim 1, including a base plate (21) configured for mounting two said skis, said plate including two laterally spaced jaws (22) extended upwardly and further having an upward bend edge (23) web configured as a front stop (20) of a hinge axis at the front sole of the shoe.

5. The ski binding of claim 4, wherein said spaced jaws (22) including aligned bores 24 and said pivotal axis member (14) is secured in said bores.

6. The ski binding of claims 4 or 5, wherein said flexor (16) is located on said base plate (21) between said two jaws (22) and the rear edge web (23), said flexor (16) including a groove (25) aligned with said bores (24), and said pivotal axis member (14) of the operating lever (15) extends transversely above the flexor (16) and within said transverse groove (25).

7. The ski binding of claim 6, wherein said rearwardly upward bend edge (23) of the base plate (21) includes an elongated hole (26) which extends parallel to the base plate and across the base plate, said flexor including a corresponding elongated hole (27) in alignment with said elongated hole (26), and said holding element (13) passing through said holes (26) and (27).

8. The ski binding of claims 4, wherein said holding element (13) is formed by a U-shaped wire lever having side shanks (18) including free ends and connected by outer end connecting web (19) and the free ends of each said shank is coupled to an opposite sides of said operating lever and configured as a pivotal support for the ski sole integrated hinge access.

9. The ski binding of claim 8, wherein the web end of the holding element in the closed position extends over the hinge axis, said hinge element portion including a recess (29) which extends parallel to the hinge access whereby during upward pivotal movement of the shoe heel against the force of the flexor (16) encounters essentially no opposing force in the opening direction of the holding element (13).

10. The ski binding according to claims 8 or 9, wherein said holding element (13) includes detent protrusions (30, 31,) connected to the operating lever (15), said base plate includes detent cut outs 34 within said lateral jaws (22), a front and/or rear edges (32,33) of the lateral jaws (22).

11. The ski binding of claim 8, wherein said wire lever having a sideview configuration substantially in the shape of an elongated "Z", said wire lever hinged to the operating lever (15) and having an outer web end oriented with the hinge axis of the shoe and extending approximately or substantially parallel to the base plate 21 of the binding with the holding element (13) moved to and fro as a result of the action of the operating lever 15.

12. The ski binding of claim 8, wherein said wire two shanks are slightly spread and generally form a V configuration, at least one of said two shanks in a portion near the connecting web (19) extends inwardly and then outwardly to form an inward offset portion (34), and said inward offset portion detentingly coacts in a closed state of the binding with the associated lateraly elongated hole 26 in base plate (21) through which said web passes.

* * * * *

UNITED STATES PATENT AND TRADEMARK OFFICE

CERTIFICATE OF CORRECTION

PATENT NO. : 6,027,135

DATED : February 22, 2000

INVENTOR(S) : BERNT-OTTO GAUGLIN

It is certified that error appears in the above-indentified patent and that said Letters Patent is hereby corrected as shown below:

In The Claims

CLAIM 1, Col. 6, line 3, Delete "complimentary" and substitute therefor --complementary; CLAIM 1, Col. 6, Line 3, After "elements" delete "," (the comma); CLAIM 1, Col. 6, Line 3, After "insertable" insert --into--; CLAIM 1, Col. 6, Line 5, Cancel "element" and substitute therefor --elements of the binding and--; CLAIM 1, Col. 5, Line 6, After "said", first occurrence, insert --complementary; CLAIM 1, Col. 6, Line 6, After "elements" second occurrence, insert --of the binding--; CLAIM 1, Col. 6, Line 7, Delete "complimentary" and substitute therefor --complementary--; CLAIM 1, Col. 6, Line 17, Delete "complimentary" and substitute therefor --complementary--; CLAIM 1, Col. 6, Line 18, After "(10)" insert --,-- (a comma); CLAIM 1, Col. 6, Line 18, delete "compli-" and substitute therefor -- comple- --; CLAIM 1, Col. 6, Line 19, Delete "configure" and substitute therefor --configured--; CLAIM 8, Col. 6, Line 61, After "sole" insert --with an--; CLAIM 8, Col. 6, Line 62, Delete "access" and substitute therefor --axis--; CLAIM 9, Col.

UNITED STATES PATENT AND TRADEMARK OFFICE

CERTIFICATE OF CORRECTION

PATENT NO. : 6,027,135

DATED : February 22, 2000

INVENTOR(S) : BERNT_OTTO GAUGLIN

It is certified that error appears in the above-indentified patent and that said Letters Patent is hereby corrected as shown below:

6, Line 66, Delete "access" and substitute therefor --axis--; CLAIM 10, Col. 7, Line 7, Delete ",a" and substitute therefor --and--

Signed and Sealed this

Third Day of April, 2001

*Attest:*

NICHOLAS P. GODICI

*Attesting Officer*

*Acting Director of the United States Patent and Trademark Office*